US005546618A

United States Patent [19]

Beedy et al.

[11] Patent Number: 5,546,618

[45] Date of Patent: Aug. 20, 1996

[54] VENTILATED MATTRESS FOR INFANTS

[76] Inventors: Robert G. Beedy, 8828 Corcoran Rd., Hometown, Ill. 60456; Raymond A. Lutz, 2507 214th St. North Lot 257, Port Byron, Ill. 61275

[21] Appl. No.: 405,106

[22] Filed: Mar. 16, 1995

[51] Int. Cl.[6] ..... A47C 27/00

[52] U.S. Cl. ..... 5/725; 5/423

[58] Field of Search ..... 5/284, 423, 468, 5/469

[56] References Cited

U.S. PATENT DOCUMENTS

| | | | |
|---|---|---|---|
| 2,493,067 | 9/1945 | Goldsmith . | |
| 3,266,064 | 8/1966 | Figman . | |
| 4,206,524 | 6/1980 | Cook | 5/469 X |
| 4,425,676 | 1/1984 | Crane . | |
| 4,536,906 | 8/1985 | Varndell et al. | 5/468 |
| 4,825,488 | 5/1989 | Bedford . | |
| 4,939,804 | 7/1990 | Grant . | |
| 5,305,483 | 4/1994 | Watkins | 5/469 X |
| 5,317,767 | 6/1994 | Hargest et al. | 5/469 |

FOREIGN PATENT DOCUMENTS

| | | | |
|---|---|---|---|
| 1035073 | 4/1966 | United Kingdom | 5/468 |
| 1391506 | 4/1975 | United Kingdom | 5/468 |

OTHER PUBLICATIONS

Sudden Death in Infants Sleeping on Polystyrene–Filled Cushions article written by James S. Kemp, M.D. and Bradley T. Thach, M.D. published in The New England Journal of Medicine on Jun. 27, 1991.

Sleeping Prone and the Risk of Sudden Infant Death Syndrome article written by Warren G. Guntheroth, M.D. and Philip S. Spiers, PhD. published in JAMA on May 6, 1992–vol. 267, No. 17.

*Primary Examiner*—Michael F. Trettel

*Attorney, Agent, or Firm*—Henderson & Sturm

[57] ABSTRACT

A mattress for infants which provides for the removal of exhaled carbon dioxide from the infant's facial area, with the resulting inflow of fresh air for breathing. A small electric fan draws the contaminated air through a series of passageways formed within the mattress, away from the infant's face, and expels it near the foot of the mattress.

3 Claims, 2 Drawing Sheets

VENTILATED MATTRESS FOR INFANTS

TECHNICAL FIELD

This invention relates to mattresses, and more particularly to crib mattresses specifically designed for the prevention of sudden infant death syndrome (SIDS) and accidental suffocation of infants.

BACKGROUND ART

Each year an estimated 8,000 to 10,000 apparently healthy infants die while resting in their cribs, thus giving rise to the terms "crib death" and Sudden Infant Death Syndrome. Unfortunately, the specific cause of these deaths remains unknown, with a resulting lack of any means of prevention.

Recently, however, it has been discovered that suffocation and SIDS are indistinguishable on postmortem examination. Infant suffocation can occur when exhaled carbon dioxide accumulates around the infant's face, as by becoming trapped by the mattress and bedding, since infants are generally placed on their stomachs to prevent the aspiration of regurgitated fluids during sleep. The trapped carbon dioxide prevents the intake of proper amounts of oxygen and the infant loses consciousness and death occurs soon thereafter.

DISCLOSURE OF THE INVENTION

The present invention discloses a mattress for infants which provides for the removal of exhaled carbon dioxide from the infant's facial area, with the resulting inflow of fresh air for breathing. A small electric blower unit draws the contaminated air through a series of channels and passageways formed within the mattress, away from the infant's face, and exhausts it near the foot of the mattress.

BRIEF DESCRIPTION OF THE DRAWINGS

These and other attributes of the invention will become more clear upon a thorough study of the following best mode for carrying out the invention, particularly when reviewed in conjunction with the drawings, wherein.

BEST MODE FOR CARRYING OUT THE INVENTION

Figure 2:
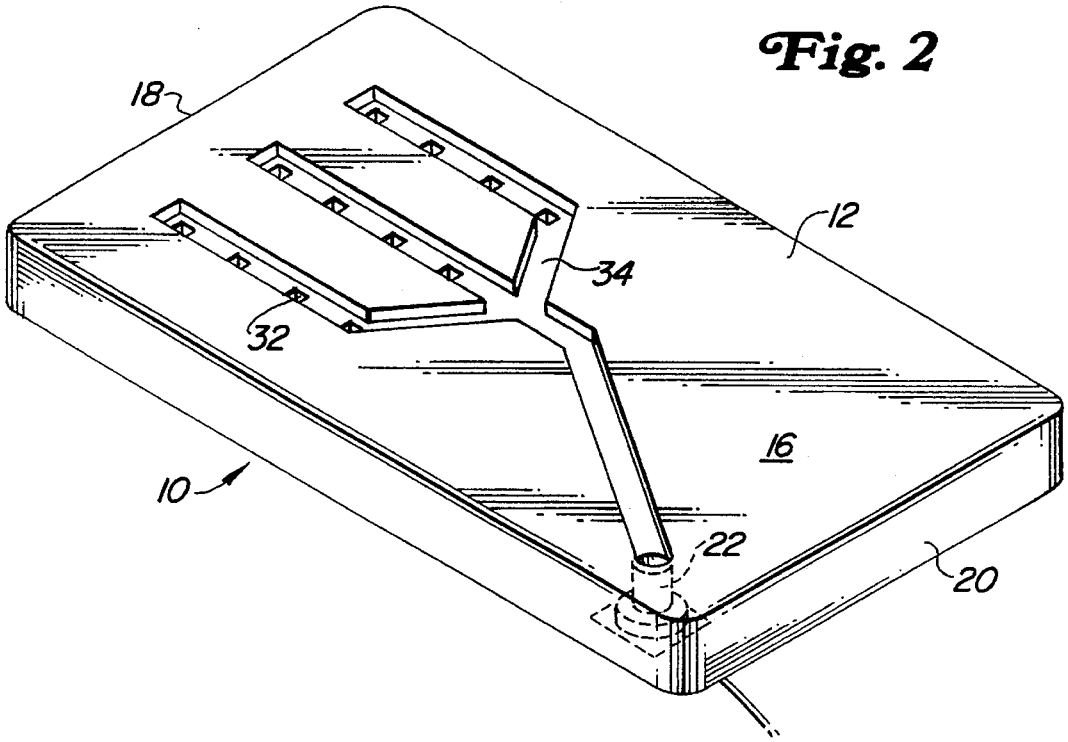
FIG. 2 is a perspective view of the bottom of the invention.
Figure 1:
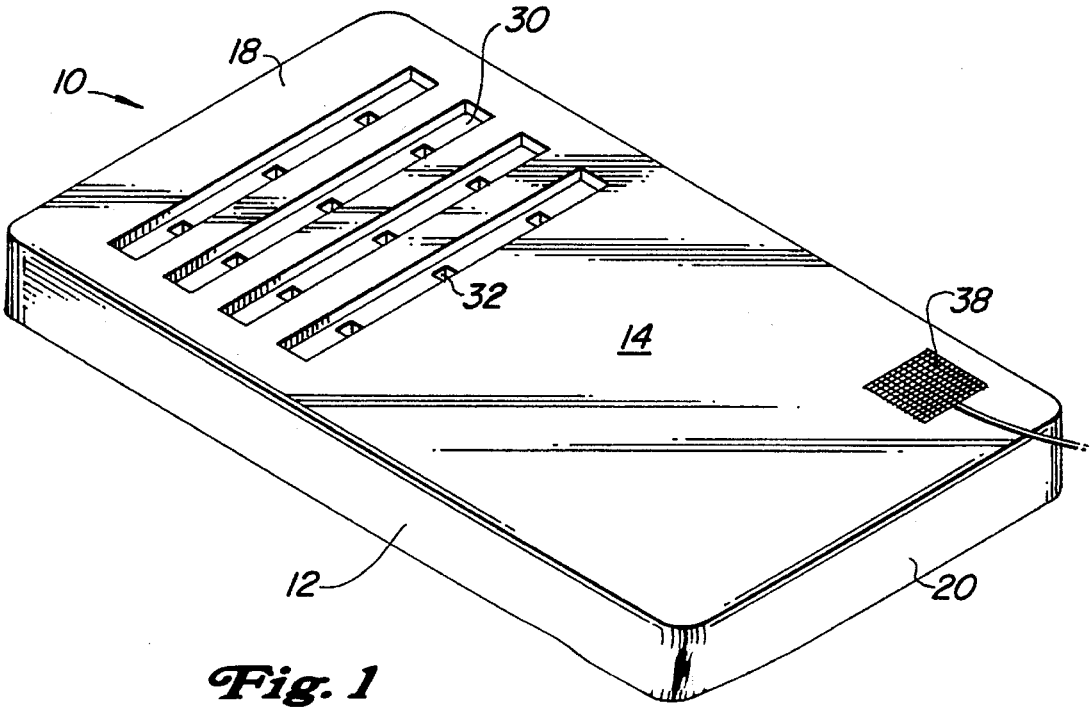
FIG. 1 is a perspective view of the top of the invention.
Figure 3:
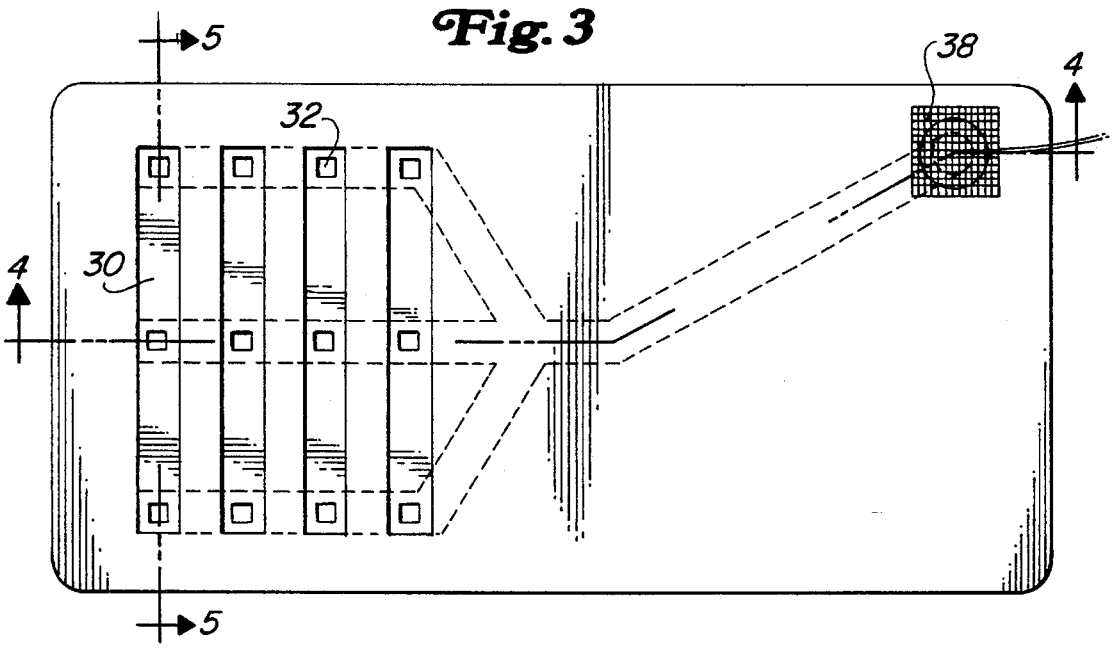
FIG. 3 is a top plan view of the invention.
Figure 4:
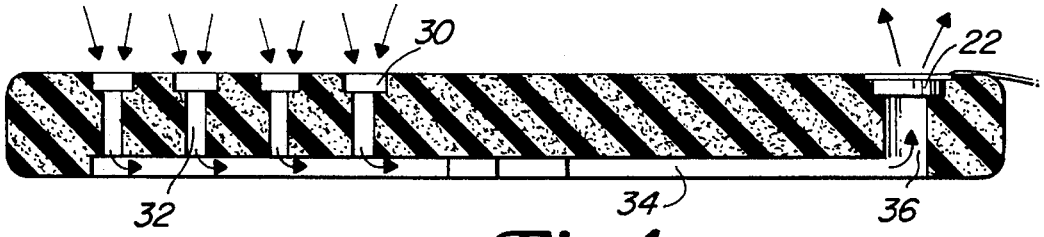
FIG. 4 is a cross-sectional view of the invention taken along line 4—4 of FIG. 3.
Figure 5:
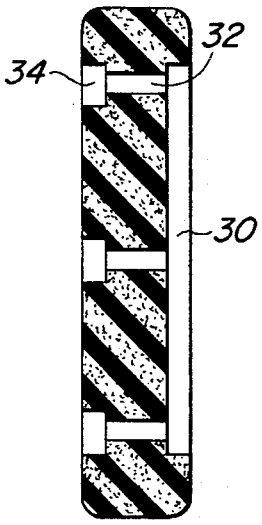
FIG. 5 is a cross-sectional view of the invention taken along line 5—5 of FIG. 3.

Referring now to the drawings, wherein like reference numerals designate identical or corresponding parts throughout the several views, the invention is designated generally at 10 and comprises a mattress 12, fabricated from foam rubber or other appropriate material, into which a series of channels and passageways have been cut or formed for the transfer of contaminated air.

The mattress 12 is preferably sized to fit standard cribs, with a length of approximately 52 inches, a width of approximately 24 inches, and a thickness of approximately four inches.

The upper surface 14 of the mattress 12 has a series of narrow breath intake channels 30 cut or formed therein near the head 18 of the mattress, the channels 30 having a depth of approximately one inch and extending across the width of the mattress approximately twenty inches. These channels 30 communicate with a plurality of exhaust ports 32, which function to pass the contaminated air down through the mattress 12 to a lower exhaust channel 34 cut or formed into the lower surface 16 of the mattress 12. The exhaust channel 34, also having a depth of approximately one inch, receives contaminated air from the exhaust ports 32 and carries it to the foot of the mattress 20, preferably near one corner. Here an exhaust passageway 36 is cut or formed through the mattress 12 which receives an electric exhaust fan 22, powered either by batteries or a low voltage power supply, which draws the contaminated air through the channels and ports and exhausts it into the atmosphere.

The opening of the exhaust passageway 36 in the upper surface 14 of the mattress 12 may be covered by a screen or mesh 38, although the exhaust fan 22 will preferably have its own safety screen covering the fan blades.

The mattress 12 is enclosed on at least its upper surface 14 by means of an open weave fabric covering (not shown) capable of easily passing the contaminated air from the infant's breathing.

Obviously, many modifications and variations of the present invention are possible in light of the above teachings. It is therefore to be understood that, within the scope of the appended claims, the invention may be practiced otherwise than as specifically described herein.

What is claimed is:

1. A safety mattress for removing exhaled breath from near the face of a resting infant, comprising:

(a) a substantially rectangular mattress having an upper surface and a lower surface, a head end and a foot end;

(b) a plurality of breath intake channels situated within said head end, upper surface of said mattress; and (c) an exhaust channel situated within said lower surface of said mattress and in communication with said breath intake channels, extending to said foot end of said mattress and having an exhaust fan affixed therein.

2. The safety mattress as recited in Claim 1, and further comprising a plurality of exhaust ports connecting said intake channels with said exhaust channel.

3. The safety mattress as recited in Claim 2 wherein said exhaust fan is battery powered.

* * * * *